United States Patent [19]

Barrington

[11] 4,448,254

[45] May 15, 1984

[54] TESTER VALVE WITH SILICONE LIQUID SPRING

[75] Inventor: Burchus Q. Barrington, Duncan, Okla.

[73] Assignee: Halliburton Company, Duncan, Okla.

[21] Appl. No.: 417,947

[22] Filed: Sep. 14, 1982

Related U.S. Application Data

[63] Continuation-in-part of Ser. No. 354,529, Mar. 4, 1982.

[51] Int. Cl.[3] ..... E21B 34/06

[52] U.S. Cl. ..... 166/373; 166/321; 166/324; 251/62

[58] Field of Search ..... 166/373, 374, 319, 321, 166/324, 325, 332, 334, 264; 92/53, 65; 251/62, 63.5; 175/93

[56] References Cited

U.S. PATENT DOCUMENTS

| | | | |
|---|---|---|---|
| Re. 29,562 | 3/1978 | Wray et al. | 166/164 X |
| 787,480 | 4/1905 | Tanner | 92/65 |
| 2,740,479 | 3/1956 | Schwegman | 166/145 |
| 3,358,755 | 12/1967 | Chisholm | 166/314 X |
| 3,431,985 | 3/1969 | Bowen | 173/119 |
| 3,646,995 | 3/1972 | Manes et al. | 166/152 |
| 3,664,415 | 5/1972 | Wray et al. | 166/264 X |
| 3,782,461 | 1/1974 | Watkins | 166/72 |
| 3,823,773 | 7/1974 | Nutter | 166/250 X |
| 3,842,913 | 10/1974 | Mott | 166/314 |
| 3,850,250 | 11/1974 | Holden et al. | 166/315 |
| 3,856,085 | 12/1974 | Holden et al. | 166/315 X |
| 3,858,649 | 1/1975 | Wray et al. | 166/162 |
| 3,860,069 | 1/1975 | Wray et al. | 166/264 |
| 3,870,104 | 3/1975 | Mott | 166/208 X |
| 3,915,228 | 10/1975 | Giebeler | 166/224 A |
| 3,930,540 | 1/1976 | Holden et al. | 166/315 |
| 3,964,305 | 6/1976 | Wray et al. | 73/151 |
| 3,964,544 | 6/1976 | Farley et al. | 166/315 |
| 3,976,136 | 8/1976 | Farley et al. | 166/264 |
| 4,047,564 | 9/1977 | Nix et al. | 166/72 |
| 4,058,165 | 11/1977 | Holden et al. | 166/314 |
| 4,059,153 | 11/1977 | Nix et al. | 166/314 X |
| 4,063,593 | 12/1977 | Jessup | 166/317 |
| 4,076,077 | 2/1978 | Nix et al. | 166/315 |
| 4,109,724 | 8/1978 | Barrington | 166/321 |
| 4,109,725 | 8/1978 | Williamson et al. | 166/315 |
| 4,113,012 | 9/1978 | Evans et al. | 166/264 |
| 4,144,937 | 3/1979 | Jackson et al. | 166/314 |
| 4,341,266 | 7/1982 | Craig | 166/317 |

OTHER PUBLICATIONS

"APR Ball Valve Tester", Halliburton Services Sales and Service Catalog—No. 39, pp. 3310-3311.

*Primary Examiner*—Stephen J. Novosad
*Assistant Examiner*—Thuy M. Bui
*Attorney, Agent, or Firm*—Joseph A. Walkowski; Thomas R. Weaver

[57] ABSTRACT

A flow tester valve apparatus includes a housing having a flow passage disposed therethrough with a flow valve disposed therein for opening and closing the flow passage. A power mandrel is disposed in the housing and includes a power piston. The power mandrel is operatively associated with the flow valve for moving the flow valve from its closed position to its open position. A power port transmits pressure from a well annulus to a first side of the power piston. A first chamber is disposed in the housing and filled at least partially with a compressible liquid and a second side of the power piston is in fluid communication with the first chamber. A second chamber is disposed in the housing and includes a floating piston which divides the second chamber into a first zone and a second zone. An equalizing port is disposed in the housing for transmitting pressure from the well annulus to the second zone of the second chamber. Pressurizing and depressurizing passages communicate the first chamber with the first zone of the second chamber. A first back pressure check valve and a first flow restrictor are disposed in the pressurizing passage. A second back pressure check valve and a second flow restrictor are disposed in the second passage. The power piston may include a main piston and a booster piston.

33 Claims, 15 Drawing Figures

TESTER VALVE WITH SILICONE LIQUID SPRING

This application is a continuation-in-part of my copending previously filed U.S. patent application Ser. No. 354,529 filed Mar. 4, 1982.

The present invention relates generally to annulus pressure responsive downhole tools utilizing a liquid spring chamber.

One operation which is often performed on a well is to flow test the well by lowering a tester valve into the well connected to a testing string, with the tester valve in the closed position until it reaches its final location within the well. Then the packer is set and the tester valve is opened by annulus pressure to allow the formation to produce through the test string. Quite often, these tester valves are constructed so that they are operated in response to changes in annulus pressure.

A typical annulus pressure responsive tester valve of the prior art of the type which has been used by the assignee of the present invention is shown, for example, in Holden et al. U.S. Pat. No. 3,856,085, and another somewhat modified example is shown at pages 3310–3311 of "Halliburton Services Sales and Service Catalog—No. 39", and designated as "APR Ball Valve Tester". Both of these tester valves utilize a chamber containing pressurized nitrogen gas as a spring chamber to bias the power piston in a direction opposite the direction in which it is biased by increased annulus pressure.

Also, it has been proposed in connection with a circulation valve to utilize such a compressed nitrogen gas chamber in combination with a floating shoe which transmits the pressure from the compressed nitrogen gas to a non-compressible liquid filled chamber, which liquid filled chamber is communicated with a well annulus through a pressurizing and depressurizing passage, each of which includes a fluid flow restriction means and a back pressure valve, to trap annulus pressure. This is shown in U.S. Pat. No. 4,113,012 to Evans et al.

One significant disadvantage of all these nitrogen gas filled valves, is that the nitrogen chamber must be filled with pressurized nitrogen gas under extremely high pressures while the valve is still located at the surface, and before it is lowered into the well. This creates safety problems due to the difficulties of containing the high pressure gas.

It has been proposed to utilize liquid springs using silicone liquid in downhole tools. This concept is discussed in U.S. Pat. No. 4,109,724 to Barrington and U.S. Pat. No. 4,109,725 to Williamson et al. both assigned to the assignee of the present invention.

The present invention provides a tester valve apparatus utilizing a silicone liquid spring chamber. Significant safety advantages are provided as compared to the nitrogen filled units since the safety problems of dealing with a high pressure nitrogen are eliminated. Additionally, the structure for and manner of operating and controlling the pressure within the silicone liquid spring chamber are improved in numerous respects as compared to the two prior silicone liquid filled tools referred to above.

The valve apparatus of the present invention includes a housing with a flow valve means disposed therein for opening and closing a flow passage of the housing. A power mandrel means is disposed in the housing and includes a power piston. The power mandrel means is connected to the flow valve means. A power passage transmits well annulus pressure to the top side of the power piston. A first chamber is disposed in the housing and filled at least partially with compressible liquid. The lower side of the power piston is in communication with this first chamber. A second chamber is also disposed in the housing and has a floating piston means disposed therein dividing the second chamber into a first zone and a second zone. An equalizing passage is disposed through the housing for transmitting well annulus pressure to the second zone of the first chamber. Both a pressurizing passage and a depressurizing passage each communicate the first chamber with the first zone of the second chamber. A first back pressure check valve means and a first fluid flow restriction are placed in the pressurizing passage for fluid communication from the first zone of the second chamber to the first chamber. A second back pressure check valve means and a second fluid flow restriction are placed in the depressurizing passage, in reverse order of those just described, for fluid communication from the first chamber to the first zone of the second chamber. This arrangement provides a means for trapping a portion of the well annulus fluid in the first chamber so as to provide liquid pressure energy for returning the power mandrel and the flow valve to the closed position upon depressurizing of the well annulus.

In an alternative embodiment of the present invention, the power piston includes a main piston and a booster piston. The booster piston aids in initially overcoming the frictional resistance of the ball valve to opening.

Numerous objects, features and advantages of the present invention will be readily apparent to those skilled in the art upon a reading of the following disclosure when taken in conjunction with the accompanying drawings.

FIG. 1 is a schematic elevation view of a representative offshore installation which may be employed for formation testing purposes and illustrates a formation testing string or tool assembly in position in a submerged well bore and extending upwardly to the floating operating and testing station.

FIGS. 2A–2J comprise an elevation section view of the tester valve of the present invention.

Figure 2A:
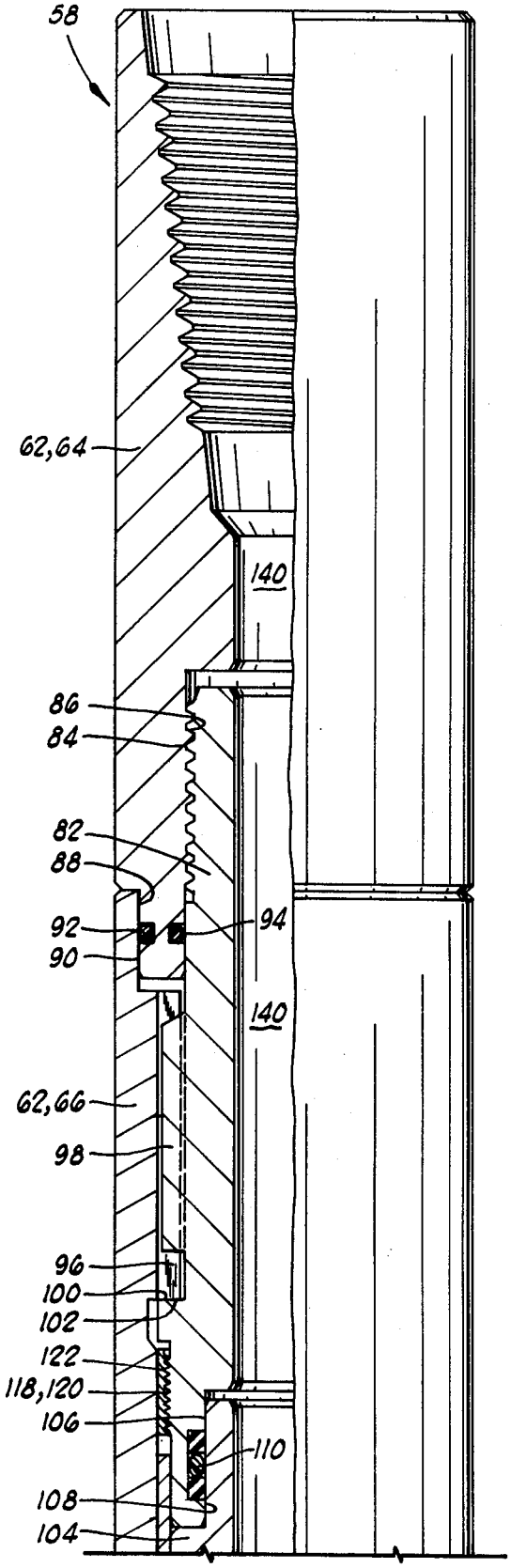
Figure 2B:
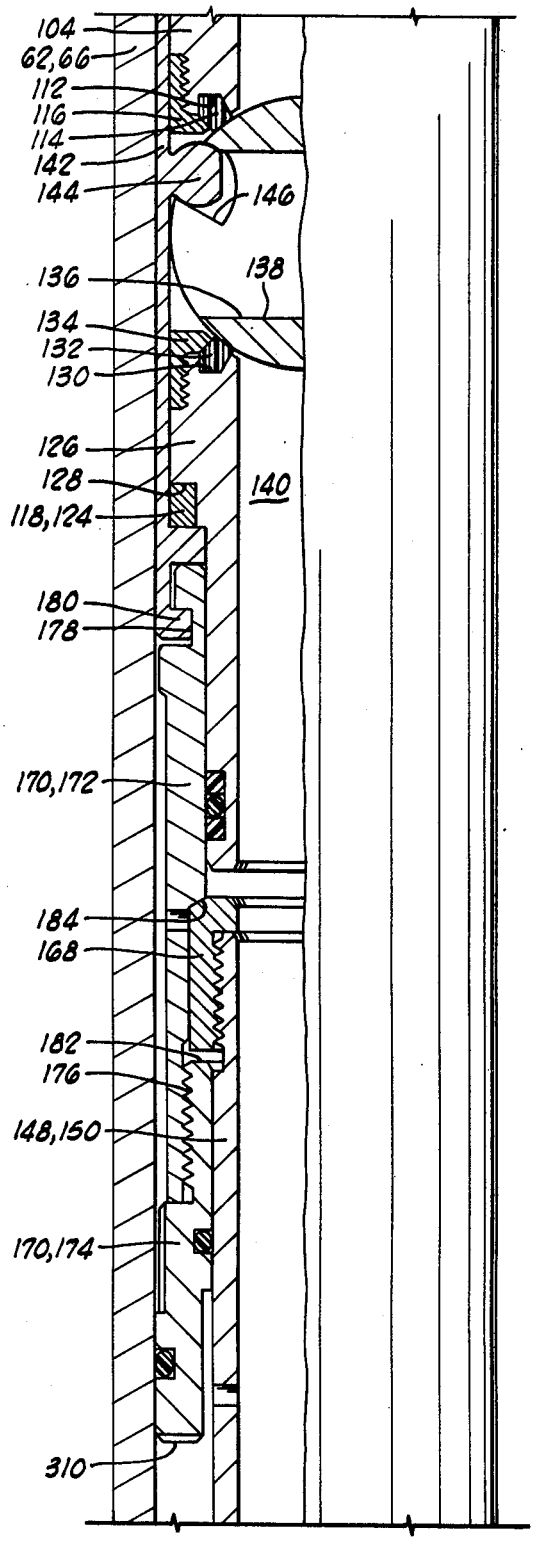
Figure 2C:
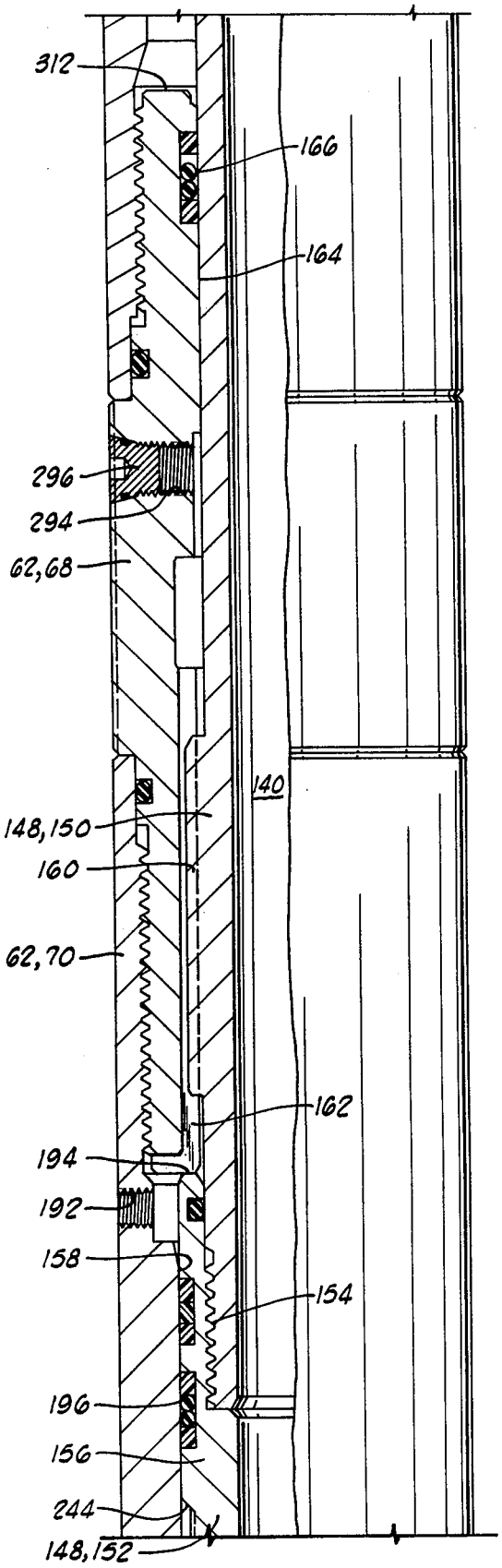
Figure 2D:
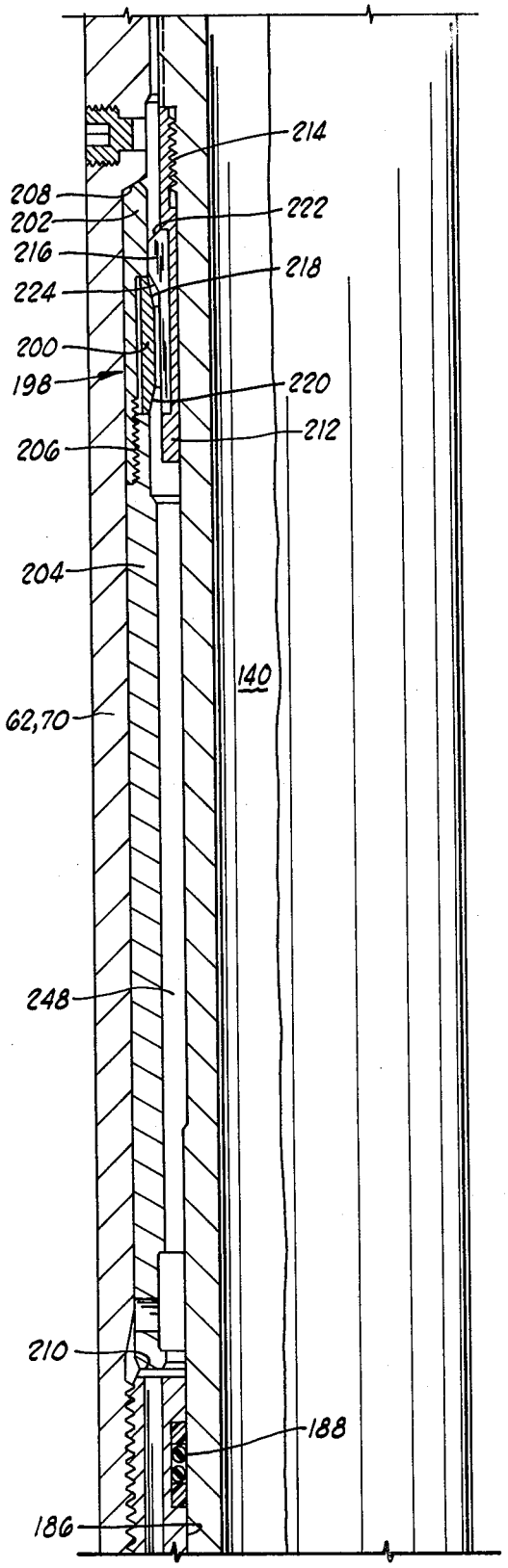
Figure 5C:
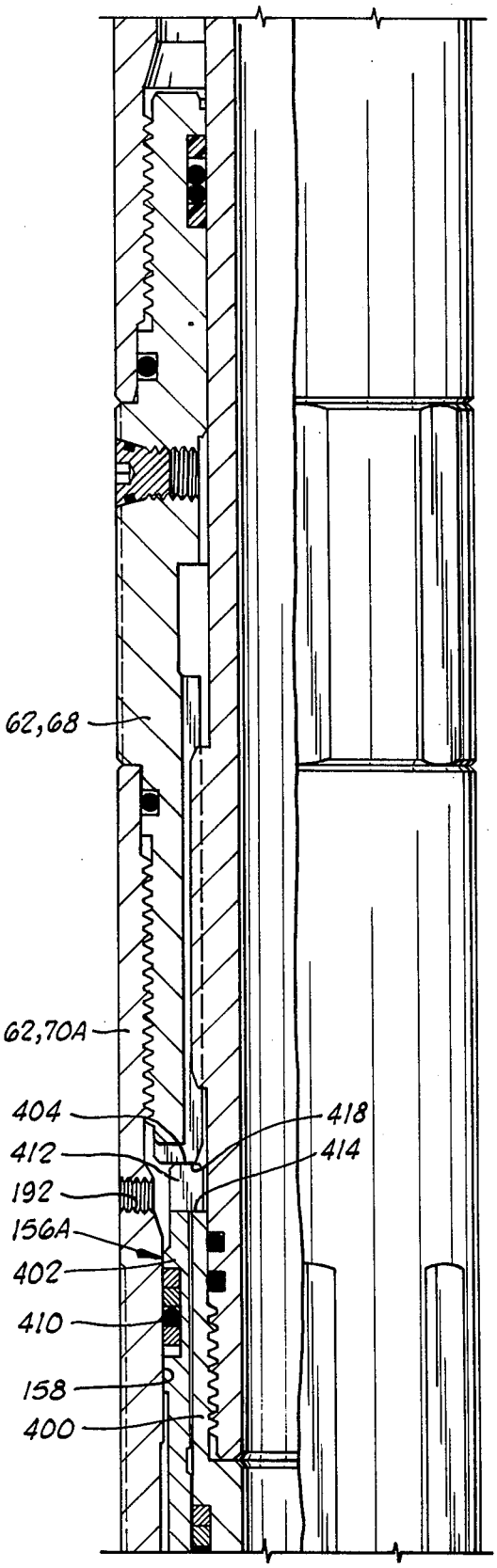
Figure 5D:
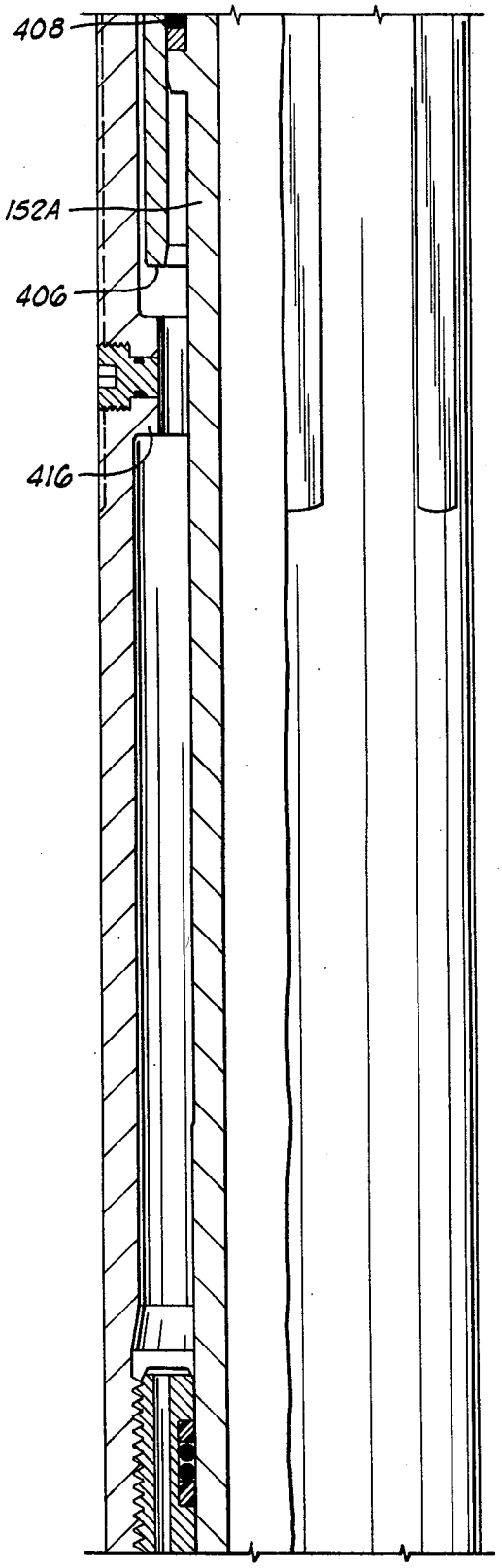

FIGS. 5C and 5D are similar to FIGS. 2C and 2D and show an alternative embodiment of that portion of the tester valve illustrated in FIGS. 2C and 2D. The power piston of FIGS. 5C and 5D includes a main piston and a booster piston. The releasable holding means of FIG. 2D has been eliminated.

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

Figure 1:
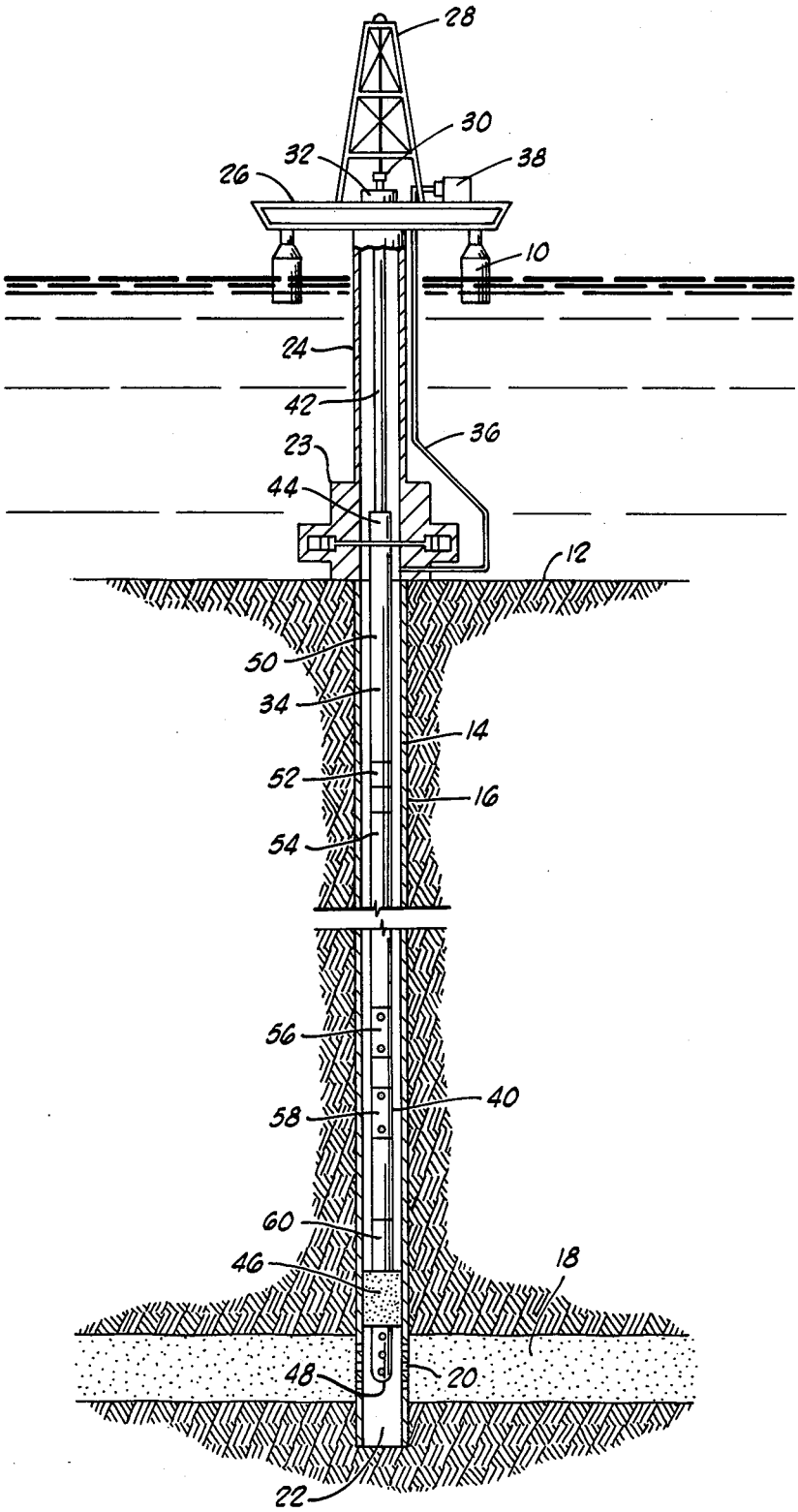

A typical arrangement for conducting a drill string test offshore is shown in FIG. 1. Such an arrangement would include a floating work station 10 stationed over a submerged well site 12. The well comprises a well bore 14 typically lined with a casing string 16 extending from the work site 12 to a submerged formation 18. The casing string 16 includes a plurality of perforations 20 at its lower end which provide communication between the formation 18 and the interior 22 of the well bore 14.

At the submerged well site is located a wellhead installation 22 which includes blowout preventer mechanisms. A marine conductor 24 extends from the wellhead installation to the floating work station 10. The floating work station 10 includes a work deck 26 which supports a derrick 28. The derrick 28 supports a hoisting means 30. A wellhead closure 32 is provided at the upper end of the marine conductor 24. The wellhead closure 32 allows for lowering into the marine conductor and into the well bore 14 a formation testing string 34 which is raised and lowered in the well by the hoisting means 30.

A supply pump conduit 36 is provided which extends from a hydraulic pump 38 on the work deck 26 of the floating station 10 and extends to the wellhead installation 22 at a point below the blowout preventers to allow the pressurizing of a well annulus 40 surrounding the testing string 34.

The testing string 34 includes an upper conduit string portion 42 extending from the work deck 26 to the wellhead installation 22. A hydraulically operated conduit string test tree 44 is located at the lower end of the upper conduit string 42 and is landed in the wellhead installation 22 to thus support the lower portion of the formation testing string 34.

The lower portion of the formation testing string 34 extends from the test tree 44 to the formation 18. A packer mechanism 46 isolates the formation 18 from fluids in the well annulus 40. A perforated tail piece 48 is provided at the lower end of the formation testing string 34 to allow fluid communication between the formation 18 and the interior of the tubular formation testing string 34.

The lower portion of the formation testing string 34 includes intermediate conduit portion 50 and torque transmitting pressure and volume balance slip joint means 52. An intermediate conduit portion 54 is provided for imparting packer setting weight to the packer mechanism 46 at the lower end of the formation testing string 34.

A circulation valve 56 is located near the lower end of the formation testing string 34. Also near the lower end of the formation testing string 34 below the circulation valve 56 is located a tester valve 58 of the present invention which is described in more detail below.

A pressure recording device 60 is located below the tester valve 58.

The testing string 34 may also include numerous other items of related equipment which is known to those skilled in the art.

DETAILED DESCRIPTION OF THE INVENTION

FIGS. 2A–2J show a cross-section elevation view of the preferred embodiment of the downhole tester valve apparatus 58 of the present invention.

The valve apparatus 58 includes an outer housing 62. The outer housing 62 itself includes an upper housing adapter 64, a valve housing section 66, an upper filler nipple 68, a power housing section 70, a liquid spring chamber connector 72, a liquid spring chamber housing section 74, a lower filler nipple 76, a lower housing section 78, and a lower housing adapter 80.

A holder mandrel 82 has an externally threaded upper end 84 threadedly connected to internally threaded surface 86 of a lower end of upper housing adapter 64.

The valve housing section 66 has an upper inner cylindrical surface 88 in which is closely received a lower outer cylindrical surface 90 of upper housing adapter 64. A resilient seal 92 is provided between surfaces 88 and 90, and a resilient seal 94 is provided between upper adapter 64 and holder mandrel 82.

The valve housing section 66 includes a plurality of radially inward extending splines 96 which are meshed with a plurality of radially outward extending splines 98 of holder mandrel 82.

Holder mandrel 82 includes a radially outward extending upward facing ledge 100 which is located below and engages lower ends 102 of the radially inward extending splines 96 so that the valve housing section 66 is held longitudinally and rotationally fixed relative to the upper housing adapter 64 by means of the holder mandrel 82.

An upper seat holder 104 has an upper cylindrical outer surface 106 closely received in a lower bore 108 of holder mandrel 82. A resilient seal 110 is provided between upper seat holder 104 and the bore 108.

Upper seat holder 104 includes a first annular groove 112 in a lower end thereof, within which is received an upper annular resilient seat 114. An upper seat retainer 116 is threadedly attached to upper seat holder 104 to hold the upper seat 114 in the groove 112.

A cylindrical collar 118 has an internally threaded upper end 120 attached to an outer threaded surface 122 of holder mandrel 82. Collar 118 has a radially inward extending lip 124 at a lower end thereof.

A lower seat holder 126 has a radially outward extending downward facing surface 128 engaging an upper side of the lip 124 of collar 118.

A second annular seat receiving groove 130 is disposed in the upper end of lower seat holder 126 and has a lower annular resilient seat 132 received therein. A lower seat retainer 134 is threadedly attached to the lower seat holder 126 to hold the lower seat 132 in the groove 130.

A ball valve 136, which may also be referred to as a full opening ball flow valve means, is spherical in shape and has a central bore 138 therethrough. The flow valve means 136 is shown in FIG. 2B in its closed position wherein its bore 138 is isolated from a longitudinal axial flow passage 140 of the tester valve apparatus 58 by the upper and lower seats 114 and 132. The flow valve means 136 sealingly engages the upper and lower resilient seats 114 and 132.

An operating means 142 includes a pin 144 which extends through a longitudinal opening in the collar 118 into an eccentric hole 146 of the flow valve means 136. Although only two small portions of the collar 118 are shown in FIGS. 2A and 2B, the collar 118 is generally an elongated cylinder in shape having a continuous upper end which shows in cross section like the upper end 120 and having a continuous lower end which shows in cross section like the lip 124 with those upper and lower ends being connected by a thin cylinder which has two longitudinal openings therein. The details of construction of collar 118 may be seen in U.S. patent application Ser. No. 355,231 of Burchus Q. Barrington entitled DOWNHOLE TESTER VALVE WITH RESILIENT SEALS, filed Mar. 5, 1982, and assigned to the assignee of the present invention.

Actually, there are two pins such as 144 which are eccentrically located on opposite sides of the bore 138 in a manner known to those skilled in the art. When the operating means 142 is moved longitudinally downward relative to the housing 62 from the position shown in FIG. 2B, the flow valve means 136 is rotated within the seats 114 and 132 to an open position wherein the bore 138 thereof is aligned with the axial flow passage 140 of the tester valve apparatus 58.

A power mandrel means 148 includes a top power mandrel section 150 and a bottom power mandrel section 152 which are threadedly connected together at 154. Formed on the bottom power mandrel section 152 is a power piston 156 which is received within a cylindrical inner bore 158 of power housing section 70.

Top power mandrel section 150 includes radially outward extending splines 160 which mesh with radially inward extending splines 162 of the lower end of upper filler nipple 68 to prevent relative rotation therebetween.

An intermediate portion of top power mandrel section 150 is closely and sealingly received within a bore 164 of upper filler nipple 68 and a seal therebetween is provided by seals 166.

A power mandrel cap 168 is threadedly attached to the upper end of top power mandrel section 150.

A connector assembly 170 includes an upper connector piece 172 and a lower connector piece 174 threadedly connected together at 176.

The upper connector piece 172 includes a groove 178 within which is received a lip 180 of operating means 142 so that operating means 142 and upper connector piece 172 move together longitudinally within the housing 62.

The power mandrel cap 168 is held between upward and downward facing surfaces 182 and 184 of connector assembly 170 so that upon longitudinal movement of power mandrel means 148, the connector assembly 170 moves longitudinally therewith which also moves the operating means 142 longitudinally therewith so as to operate the closure valve means 136.

A lower end of bottom power mandrel section 152 is closely slidably and sealingly received within a central bore 186 of liquid spring chamber connector 72. The seals therebetween are provided by seals 188 and 190.

A power port 192 is disposed through a wall of power housing section 70 and arranged to be in fluid communication with an upper side 194 of power piston 156.

A seal is provided between piston 156 and bore 158 at 196.

A releasable holding means 198 includes a radially resilient collet sleeve 200 held in place within the housing 62 by upper and lower collet retainer pieces 202 and 204 which are threadedly connected together at 206. The assembled upper and lower collet retainer pieces 202 and 204 are held between a downward facing ledge 208 of power housing section 70 and an upper end 210 of liquid spring chamber connector 72.

Releasable holding means 198 also includes a shoulder piece 212 threadedly connected to bottom power mandrel section 152 at threaded connection 214. Shoulder piece 212 includes thereon a plurality of radially outward extending shoulders 216.

Collet sleeve 200 includes upper and lower tapered surfaces 218 and 220, and shoulder 216 includes upper and lower tapered surfaces 222 and 224 arranged so that when shoulder 216 moves past sleeve 200 one of said tapered surfaces of the shoulder 216 engages one of the tapered surfaces of the sleeve 200 and causes the sleeve 200 to expand radially to allow the shoulder 216 to pass therethrough.

A liquid spring chamber mandrel means 226 includes an upper spring chamber mandrel piece 228 and a lower spring chamber mandrel piece 230 connected together at threaded connection 232.

An upper end of upper spring chamber mandrel piece 228 is threadedly connected to liquid spring chamber connector 72 at threaded connection 234.

A lower end 236 of lower spring chamber mandrel piece 230 is closely received within a bore 238 of lower filler nipple 76 and a seal therebetween is provided by seal 240.

Liquid spring chamber mandrel means 226 is spaced radially inward from liquid spring chamber housing section 74 so as to define an annular main spring chamber 242. Main spring chamber 242 communicates with a lower side 244 of power piston 156 through a connecting bore 246 disposed through liquid spring chamber connector 72 and an annular space 248 between power housing section 70 and bottom power mandrel section 152.

A lower mandrel 250 has an upper end connected to lower filler nipple 76 at threaded connection 252 and a lower end sealingly received in a bore 254 of lower housing adapter 80. A seal is provided between lower mandrel 250 and bore 254 by seal 256.

The lower mandrel 250 is spaced radially inward from lower housing section 78 to define an annular equalizing chamber 258.

A cylindrical metering cartridge 260 is disposed between lower housing section 78 and lower mandrel 250 at an upper end of equalizing chamber 258.

A pressurizing passage means 262 includes an upper portion 264 disposed in lower filler nipple 76 and a lower portion 266 disposed in metering cartridge 260. Pressurizing passage means 266 communicates main spring chamber 242 with equalizing chamber 258.

Pressurizing back pressure check valve 268 is disposed in lower portion 266 of pressurizing passage means 262 for allowing liquid to flow from equalizing chamber 258 to the main spring chamber 242.

A first time delay liquid flow restriction 270 is disposed in lower portion 266 of pressurizing passage means 262. Also, a filter 271 is disposed in lower portion 266 of pressurizing passage means 262.

A depressurizing passage means 272 includes an upper portion 274 disposed in lower filler nipple 76 and a lower portion 276 disposed in metering cartridge 260. Depressurizing passage means 272 also communicates main spring chamber 242 with equalizing chamber 258.

A depressurizing back pressure check valve 278 is disposed in lower portion 276 of depressurizing passage means 272. A second time delay liquid flow restriction 280 is disposed in lower portion 276 of depressurizing passage means 272. Also, a filter 281 is disposed in lower portion 276 of depressurizing passage means 272.

A floating piston means 282 is disposed in equalizing chamber 258 between lower housing section 78 and lower mandrel 250. Seals 284 and 286 are provided between piston 282 and lower housing section 78. Seals 288 and 290 are provided between floating piston 282 and lower mandrel 250.

An equalizing port 292 is disposed through a wall of lower housing section 78 near a lower end thereof.

Upper filler nipple 68 has a fill port 294 disposed therethrough which is closed by a threaded plug 296.

Lower filler nipple 76 includes a fill port 298 closed by a plug 300. Lower filler nipple 76 also includes a second filler port 302 closed by a plug 304.

Lower housing section 78 includes a filler port 306 closed by a plug 308.

Thus, the valve apparatus 58 may generally be said to include the housing 62 having the flow passage 140 disposed therethrough.

Flow valve means 136 is disposed in the housing 62 and is movable between a closed position as shown in FIG. 2B wherein the flow passage 140 is closed, and an open position wherein the bore 138 of flow valve means 136 is aligned with flow passage 146 so that the flow passage 140 is open.

The power mandrel means 148 is disposed in the housing 62 and includes the power piston 156. The power mandrel means 148 is operatively associated with the flow valve means 136 for moving the flow valve means 136 from its closed position to its open position in one continuous movement upon movement of the power mandrel means 148 longitudinally within the housing 62 from the first position illustrated in FIGS. 2B–2E in one continuous movement to a second position wherein the power mandrel means 148 is moved longitudinally downward from the position shown in FIGS. 2B–2E until a lower end 310 of lower connector piece 174 engages an upper end 312 of upper filler nipple 68. The valve means 136 thus snaps open, rather than opening slowly or in incremental steps, and this minimizes fluid erosion problems.

The power port 192 may be described as a power passage means 192 disposed in the housing 62 for transmitting pressure from the well annulus 40 external of the housing 62 to the upper or first side 192 of power piston 156.

A liquid spring chamber, which may also be generally referred to as a first chamber disposed in the housing 62, includes the entire space communicating the bottom or second side 244 of power piston 156 with the fluid flow restricters 270 and 280 disposed in the metering cartridge 260. This first chamber includes a number of the spaces previously defined such as the annular space 248, the bore 246, the main spring chamber 242, and the upper portion 264 of equalizing passage 262 as well as all the other liquid spaces communicated therewith.

In the embodiment shown in FIGS. 2A–2E, this entire first chamber is filled with a compressible liquid which is preferably a silicone oil such as that sold under the trademark DOW CORNING 200. The basic properties of that compressible fluid and its changing compressibility characteristics with changes in pressure and temperature are described in detail in U.S. Pat. No. 4,109,724 to Barrington and U.S. Pat. No. 4,109,725 to Williamson et al. both assigned to the assignee of the present invention.

Also disposed in the housing 62 is the equalizing chamber 258 which may also generally be referred to as a second chamber. The equalizing chamber 258 is divided into a first zone 314 and a second zone 316 by the floating piston means 282 seen in FIG. 2I. The equalizing port 292 may generally be described as an equalizing passage means disposed in the housing 62 for transmitting pressure from the well annulus 40 external of the housing 62 to the second zone 316 of the equalizing chamber 258.

The pressurizing passage means 262 and the depressurizing passage means 272 both communicate the main spring chamber portion 242 of the first chamber with the first zone 314 of the second or equalizing chamber 258.

The pressurizing back pressure check valve means 268 allows liquid to flow from the first zone 314 of the equalizing chamber 258 through the pressurizing passage 262 into the main spring chamber portion 242 when a pressure in the first zone 314 of equalizing chamber 258 exceeds a pressure of the compressible liquid in the main spring chamber 242 by a first predetermined value. The pressurizing back pressure check valve means 268 prevents liquid from flowing from the main spring chamber 242 through the pressurizing passage 262 to the first zone 314 of equalizing chamber 258.

The depressurizing back pressure check valve means allows liquid to flow from the main spring chamber 242 through the depressurizing passage 272 into the first zone 314 of equalizing chamber 258 when the pressure in the main spring chamber 242 exceeds the pressure in the first zone 314 of equalizing chamber 258 by a second predetermined value. This second predetermined value is greater than the first predetermined value. The depressurizing back pressure check valve means 278 prevents liquid from flowing from the first zone 314 of equalizing chamber 258 through the depressurizing passage means 272 into the main spring chamber 242.

In the embodiment shown in FIGS. 2A–2E, the entire first chamber, including all of the main spring chamber 242, is completely filled with the compressible liquid and also the first zone 314 of equalizing chamber 258 is completely with compressible liquid so that it is the compressible liquid which flows through the metering cartridge 260.

Figure 3:
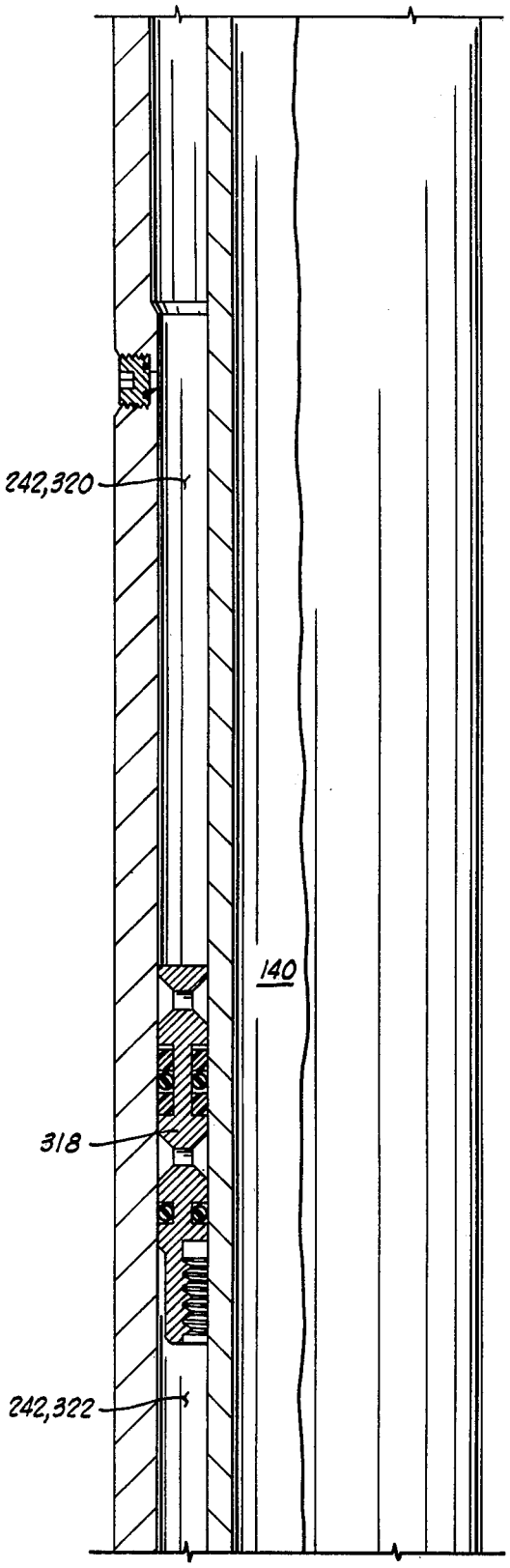
FIG. 3 is a view similar to FIG. 2G illustrating an alternative embodiment of the tool of FIGS. 2A–2J wherein a second floating piston is provided in the first chamber.

In certain installations, wherein the amount of flow back and forth through the flow restricting orifices 270 and 280 is particularly great, there may be a problem of foaming of a compressible liquid such as silicone oil, and in that situation an alternative embodiment of the present invention may be preferable wherein a second floating piston 318 is provided in the main spring chamber 242 such as shown in FIG. 3.

This second floating piston divides the main spring chamber 242 into an upper first zone 320 and a lower second zone 322. The first zone 320 is completely filled with the compressible silicone oil liquid. The second zone 322 of the main spring chamber 242 and the first zone 314 of equalizing chamber 258 are both filled with a substantially noncompressible liquid, such as hydraulic oil, which will not present any foaming problem as it passes back and forth through the fluid flow restrictions.

With this one modification, the embodiment of FIG. 3 is otherwise the same as the embodiment of FIGS. 2A–2J.

Continuing with the description of the embodiment of FIGS. 2A–2J, it is necessary that an initial volume of the first chamber when the power mandrel means is in its first position, as illustrated in FIGS. 2A–2J, be sufficiently large that the amount of compressible silicone oil liquid in the first chamber may be compressed into a final volume of the first chamber as the power mandrel means 148 moves rapidly downward from its first position to its second position wherein the surfaces 310 and 312 engage. This requires that the silicone oil have sufficient compressibility at the pressures and temperatures involved during the operation of the tester valve apparatus 58 that it can be compressed by a volume at least as great as the volume displaced by the power piston 156 when it moves from its first position shown in FIGS. 2C–2E to its second position wherein the surfaces 310 and 312 engage as previously described.

A specific detailed example of such a construction is given in U.S. Pat. No. 4,109,724 to Barrington, and assigned to the assignee of the present invention, at column 10, line 52–column 11, line 13 thereof, which is incorporated herein by reference.

Figure 2E:
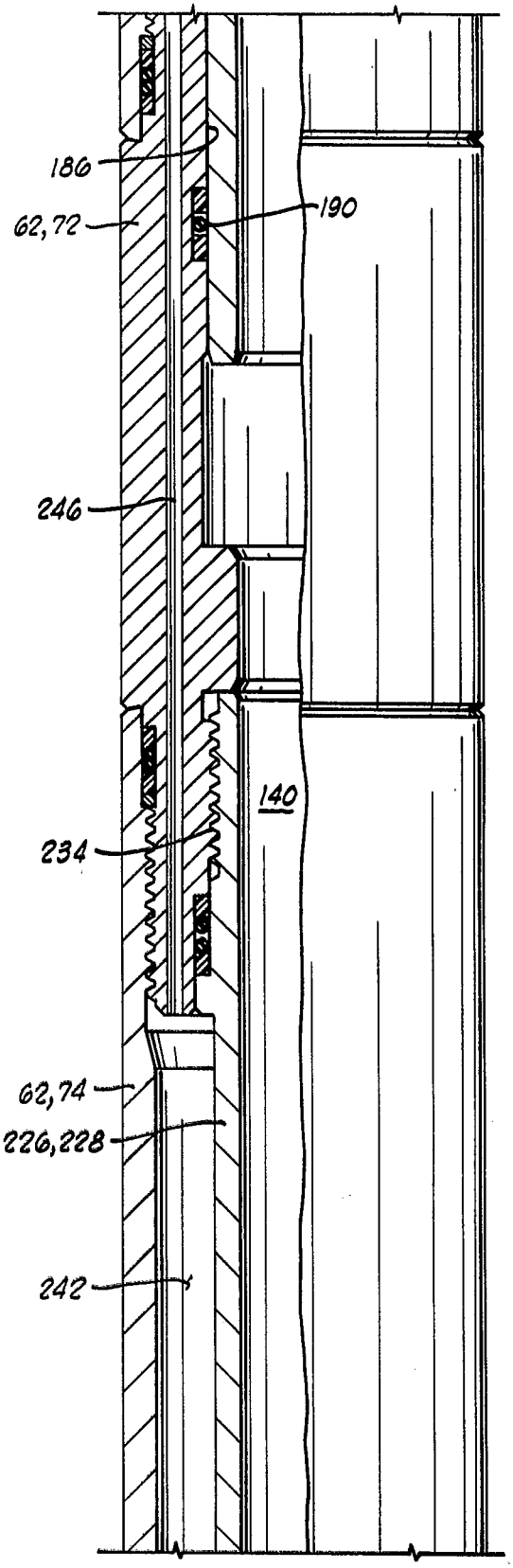
Figure 2F:
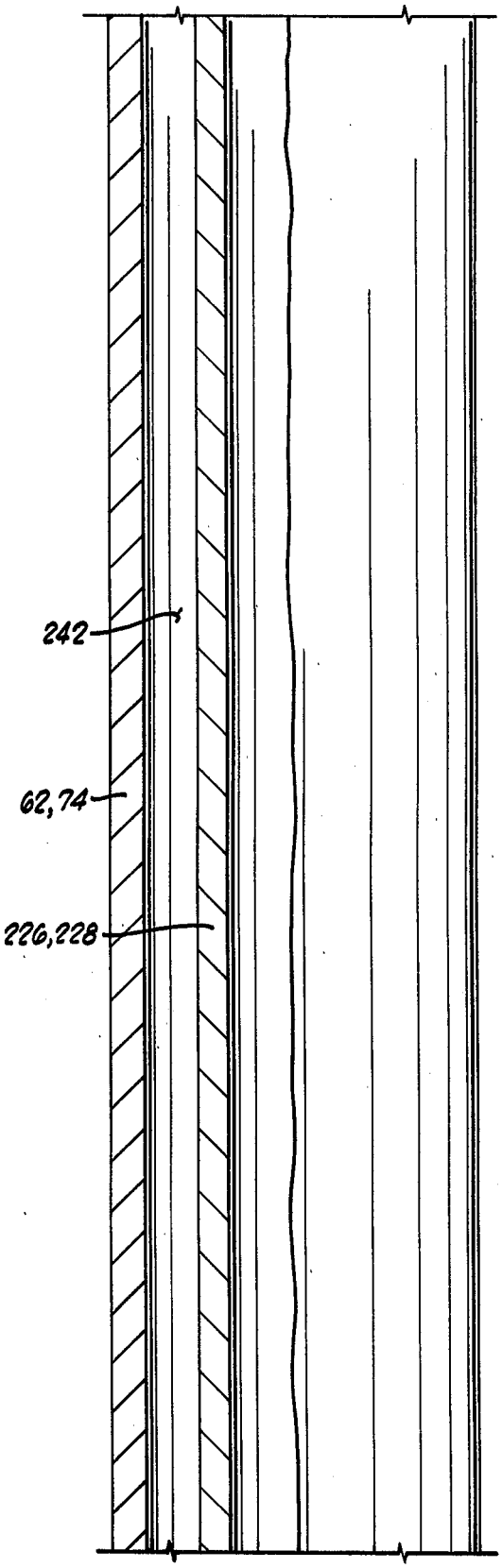
Figure 20:
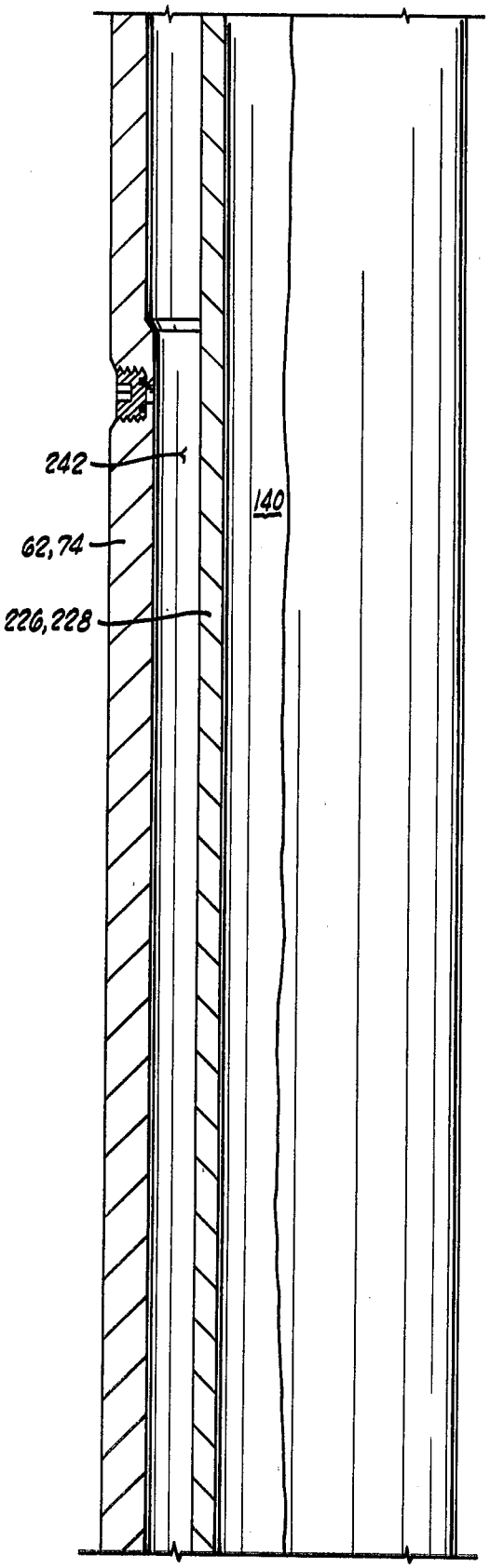
Figure 21:
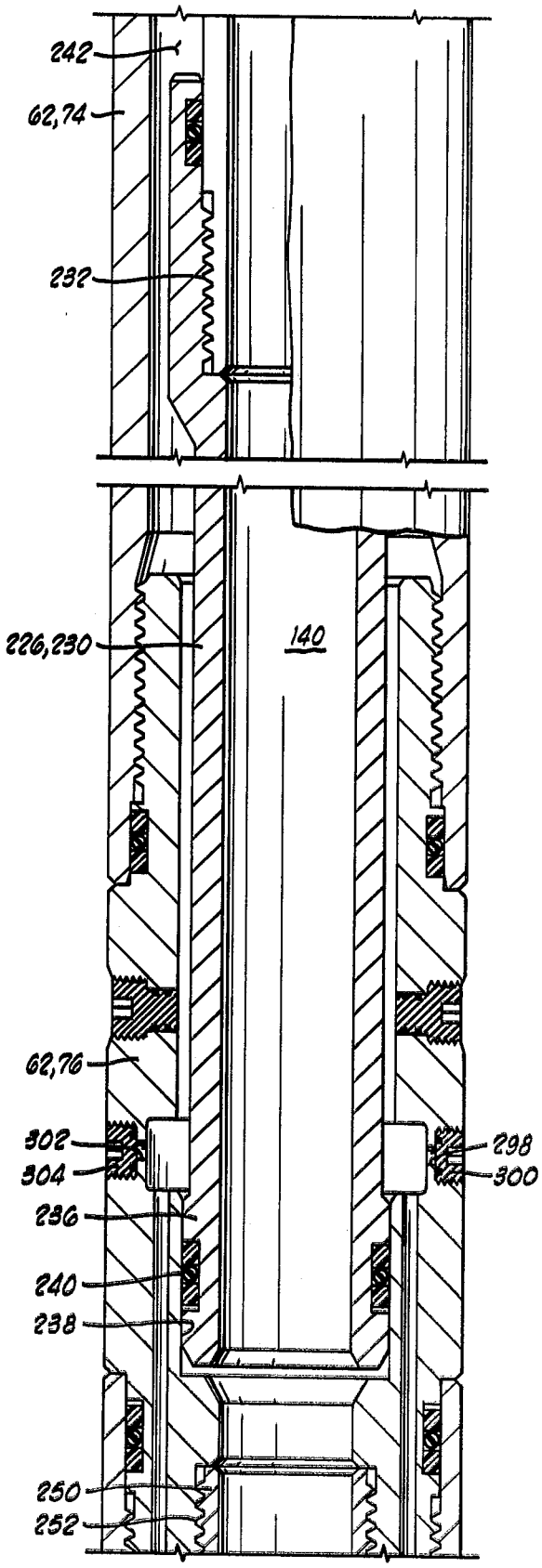
Figure 2I:
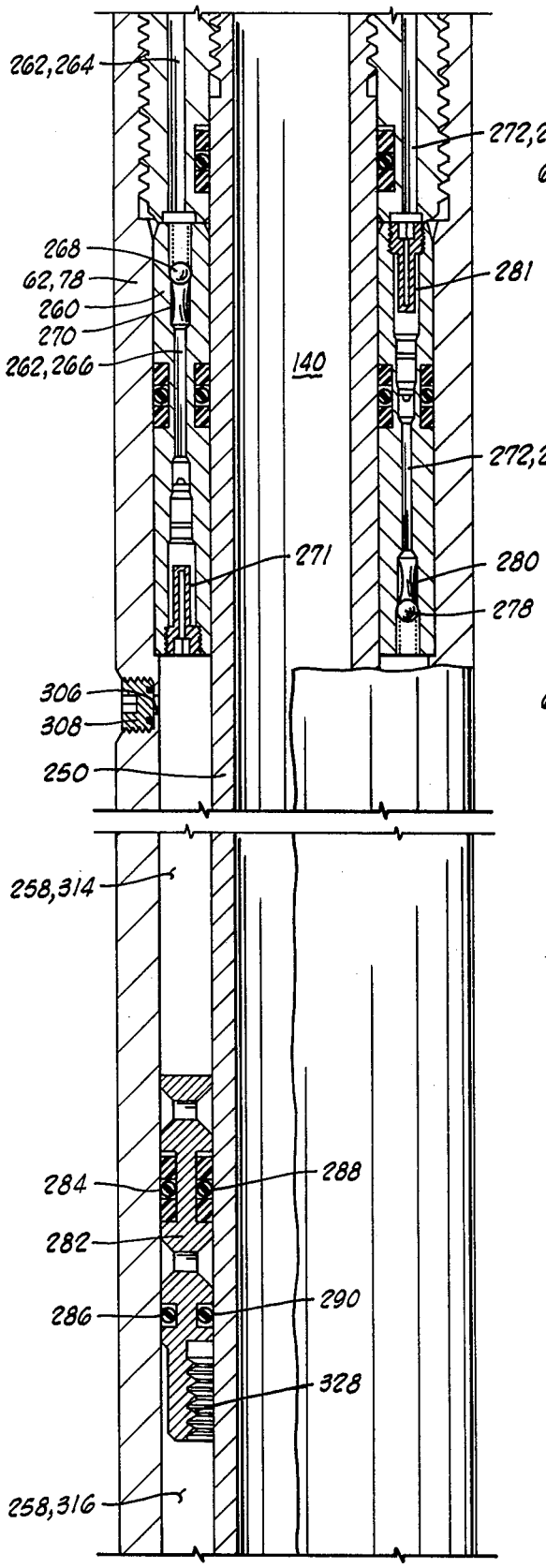
Figure 2J:
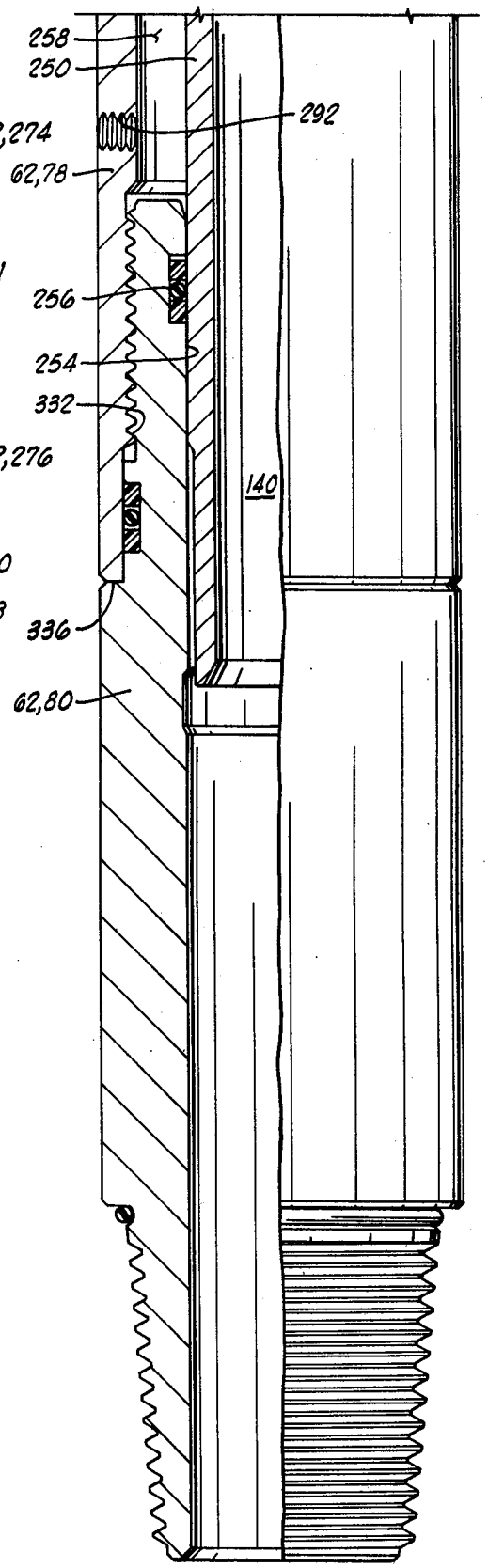

The back pressure check valves 268 and 278 are constructed such that the second predetermined value of the depressurizing back pressure check valve 278 exceeds the first predetermined value of the pressurizing back pressure check valve 268 by an amount sufficient that when a pressure differential of such amount is applied across power piston 156 from the second side 244 toward the first side 194 thereof, when the power mandrel means 148 is in its second position with the surfaces 310 and 312 engaged, a sufficient force is exerted on the power piston 156 to move the power mandrel means 148 back to its first position illustrated in FIGS. 2C–2E.

The first flow restrictor 270 which may also be referred to as a flow impedance means 270, is disposed in the pressurizing passage means 262 and impedes the flow of liquid through the pressurizing passage 262 so that upon rapid pressurization of the well annulus 40 an annulus fluid pressure in the annulus 40 will increase faster than the annulus fluid pressure can be transmitted through the pressurizing passage 262 to the main spring chamber 242, thereby creating a pressure differential across the power piston 156 from the upper first side 194 toward the lower second side 244 thereof sufficient to move the power mandrel means 148 from its first position shown in FIGS. 2C–2E to its said second position previously described with surfaces 310 and 312 engaged to thereby open the flow valve means 136.

The second liquid flow restrictor 280 which may be generally described as a second flow impedance means 280, disposed in the depressurizing passage 272, impedes flow of liquid through the depressurizing passage 272 so that when the power mandrel means 148 is in its said second position with the surfaces 310 and 312 engaged, and the well annulus 40 is rapidly depressurized, an annulus fluid pressure in annulus 40 will decrease faster than the pressure of the compressible liquid in the main spring chamber 242 will decrease, thereby creating a pressure differential across the power piston 156 from the lower second side 244 thereof toward the upper first side 194 thereof. This pressure differential is greater than an amount by which the second predetermined value of the depressurizing back pressure check valve 278 exceeds the first predetermined value of the pressurizing back pressure check valve 268. In other words, upon rapid depressurization of the well annulus, there is for a period of time a pressure trapped in the main spring chamber 242 due to the time delay provided by the liquid flow restrictor 280 which exceeds the difference in operating pressure between the check valves 268 and 278.

The releasable holding means 198 is operably associated with the housing 62 and the power mandrel means 148, for holding the power mandrel means in its first position until a pressure differential across the power piston 156 from the upper first side 194 thereof toward the lower second side 244 thereof exceeds a third predetermined value, and for then holding the power mandrel means 148 in its said second position with the surfaces 310 and 312 engaged until a pressure differential across the power piston 156 from its second side 244 toward its first side 194 thereof exceeds a fourth predetermined value, which fourth predetermined value is less than the difference between the first predetermined value of pressurizing back pressure check valve 268 and the second predetermined value of depressurizing back pressure check valve 278. In other words, the pressure differential required across the power piston 156 to force the shoulders 216 attached to the bottom power mandrel section 152 through the collet sleeve 200 is less than the minimum pressure which will be trapped within the main spring chamber 242 due to the different operating pressures of the check valves 268 and 278, thus assuring that even if the well annulus 40 is depressurized very slowly, sufficient pressure will be trapped within the main spring chamber 242 to move the power mandrel means back upward to its first position to close the flow valve means 136.

It will be appreciated that the floating piston means 282 in the equalizing chamber 258 may move in either of two opposite directions relative to the housing 62, i.e., either upward or downward, to either increase or decrease a volume of the first zone 314 of equalizing chamber 258 to allow for either expansion or contraction of the compressible silicone oil liquid due to pressure and temperature changes as the tester valve apparatus 58 is lowered into the well bore 14.

Figure 4:
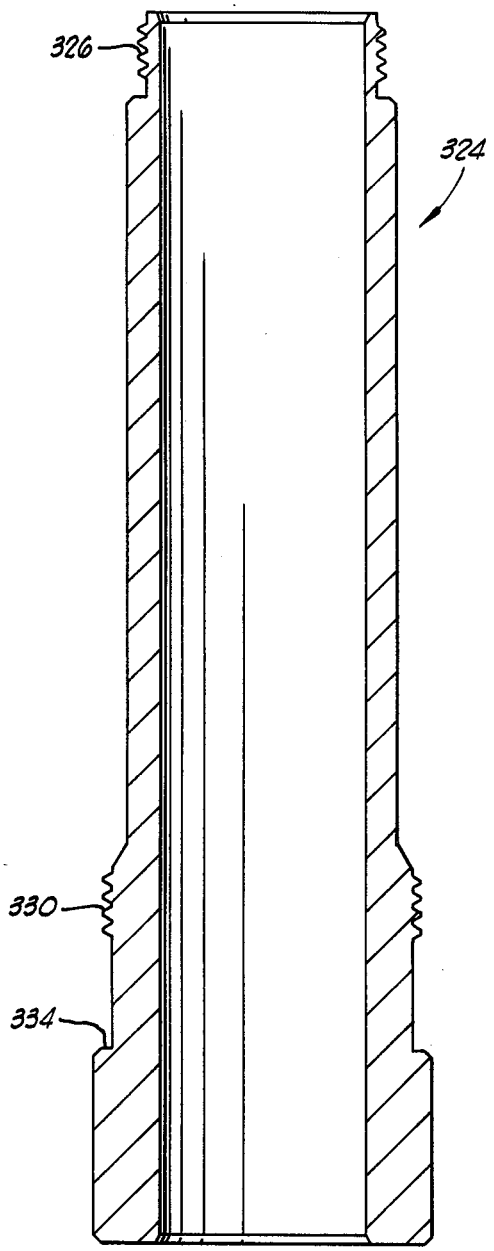
FIG. 4 is an elevation section view of a locater tool for initially positioning the lower floating piston within the equalizing chamber.

It is important that the floating shoe 282 be initially located at the proper position within equalizing chamber 258 to allow sufficient movement both upward and downward to accommodate all possible volume changes of the compressible liquid encountered during the lowering of the tester valve apparatus 58 into any particular well 14. Accurate positioning of the floating piston 282 is accomplished by means of a positioning tool 324 shown in FIG. 4.

Positioning tool 324 includes an upper threaded portion 326 which threadedly engages an internal lower threaded portion 328 of floating piston 282.

The positioning tool 344 also includes a second threaded portion 330 which threadedly engages the threads 332 of the lower end of lower housing section 78. When the upward facing shoulder 334 of positioning tool 324 engages the lower end 336 of lower housing section 78 the floating piston 282 will be properly located within the equalizing chamber 258. Then the locating tool 324 is unthreaded from the piston 282 and the lower housing section 78 thus leaving the piston 282 in its proper place within the equalizing chamber 258.

The general manner of flow testing a well utilizing the flow tester valve of the present invention with the improved silicone oil liquid spring is as follows. First, a flow pressure valve like the flow tester valve apparatus 58 is provided.

Prior to placing the valve apparatus 58 in the well 14, the liquid spring means, i.e., the compressible fluid located in the first chamber, is maintained at substantially atmospheric pressure. Thus, the danger encountered with prior art tools wherein the compressible fluid, namely nitrogen gas thereof, must be initially placed under high pressures with its accompanying safety hazards to personnel handling the tool is eliminated.

Then the flow tester valve apparatus is lowered into the well bore 14 with the liquid spring means initially still at substantially atmospheric pressure as the lowering is begun.

As the flow tester valve apparatus 58 is lowered into the well bore 14, annulus fluid pressure from the annulus 40 is transmitted to the liquid spring means through the equalizing chamber 258 and the pressurizing passage 262.

In a preferred embodiment of the present invention, the pressurizing back pressure check valve 268 is set to open at a pressure differential of 80 psi and the liquid flow restrictor 270 provides a two-minute time delay such that any liquid pressure differential takes two minutes to be completely transmitted therethrough. Thus, as the flow tester valve 58 is lowered into the well bore 14, the pressure in the main spring chamber 242 lags the pressure in the equalizing chamber 258 by 80 psi plus a time lag of two minutes.

This time lag is set to be long enough so that the pressure in main spring chamber 242 will not be effected by rapid changes in annulus pressure, and short enough so that with normal rates of lowering a stand of drill pipe into the well the increase in hydrostatic head as the tester valve 58 is lowered into the well will not occur sufficiently fast to prematurely actuate the flow valve means 136.

The flow tester valve is lowered until it is located within the well bore 14 at a final depth wherein the packer 46 is set against the casing 16.

Then the annulus 40 is rapidly pressurized an additional amount above the hydrostatic pressure which is already present therein sufficient to open the flow valve means 136 of the apparatus 58.

When the annulus 40 is rapidly pressurized this increased pressure is communicated to the upper end 194 of power piston 156 through the power port 192, but is not initially transmitted to the main spring chamber 242 because of the two-minute time delay provided by flow restrictor 270 in the pressurizing passage 262. Thus the pressure on the top of power piston 156 exceeds the pressure communicated with the lower side 244 of power piston 156 and the power piston 156 is moved downward compressing the compressible liquid located within the first chamber and particularly within the main spring chamber 242.

This pressure differential must be sufficient to push the shoulder 216 through the collet sleeve 200 and to compress the compressible silicone liquid located in the first chamber. This opens the flow valve means 136 so that its bore 138 is aligned with the flow passage 140 of the apparatus 158. In a preferred embodiment of the present invention, a pressure differential of 450 psi across the power piston 156 is required to force shoulder 216 through collet sleeve 200, thus the third and fourth predetermined values mentioned above are each equal to 450 psi.

The well annulus pressure is maintained at this high level while the flow test is performed. After a period of two minutes, the pressure within the main spring chamber 242 will reach a value 80 psi less than the well annulus pressure.

Thus, at least a portion of the additional amount of annulus pressure provided to the well annulus 40 when it was rapidly pressurized is transmitted to the liquid spring means in the first chamber.

When it is desired to close the flow valve means 136, the well annulus 40 is rapidly depressurized to a final annulus pressure much less than the prior high annulus pressure.

As the annulus 40 is depressurized rapidly, this pressure change is not immediately seen in the main spring chamber 242 because the liquid flow restrictor 280 in the depressurizing passage means 272 prevents the rapid flow of liquid from the main spring chamber 242 into the first zone 314 of the equalizing chamber 258, thus trapping the pressure in the liquid spring means for a period of time after the annulus 40 is depressurized. Thus, upon initial depressurization, the pressure trapped within the main spring chamber 242 greatly exceeds the pressure in the well annulus 40 and thus a pressure differential is directed upward against the power piston 156 thus moving the power mandrel means 148 upward to its first position and moving the flow valve means 136 to its closed position.

The value of the pressure differential at which the depressurizing back pressure check valve 278 operates is higher than the first predetermined value of the pressurizing back pressure check valve 268, and in a preferred embodiment is 600 psi, so that even after more than two minutes have passed since the depressurization of the annulus 40, a minimum portion of the pressure in the main spring chamber 242 which has remained trapped is at least 600 psi minus 80 psi or a total of 520 psi which will always remain trapped in the main spring chamber 242.

The releasable holding means 198 is constructed to be overcome by a pressure differential of only 450 psi so that this minimum trapped pressure, namely, 520 psi, provides sufficient force to move the power piston 156 and the power mandrel means 148 back upward to the first position of the power mandrel means 148.

Also, it has been determined that in some circumstances it is not necessary to provide a releasable holding means such as 198, but rather the inherent frictional forces opposing movement of the valve means 136 and the attached structure may be relied upon to prevent premature operation of the valve means 136.

This may be described in terms of the liquid pressure energy which is trapped within the first chamber by means of compression of the compressible fluid therein. It may generally be said that a trapped amount of liquid pressure energy trapped in the liquid spring means, in excess of the liquid pressure energy which was present in the liquid spring means when the liquid spring means was at substantially atmospheric pressure, is entirely obtained from transmittal of liquid pressure energy from the well annulus 40 to the liquid spring means while the apparatus 58 is being lowered into the well bore 14. This means that all of the liquid pressure energy present to reclose the flow valve means 136 was provided from the annulus 40 and none of it was initially provided by any initial pressurization of the compressible liquid prior to placing the tool in the well. This is in contrast to prior art wherein much of the fluid pressure energy contained in a nitrogen-filled tool is placed in the nitrogen chamber prior to the time that the tool is placed in the well bore.

This trapped liquid pressure energy is utilized to close the flow valve means 136 upon depressurizing of the well annulus 40 as previously described.

ALTERNATIVE EMBODIMENT OF FIGS. 5C-5D

Referring now to FIGS. 5C-5D, an alternative preferred embodiment of the present invention is thereshown. In this preferred embodiment, the power piston includes a main piston and a booster piston, and the releasable holding means has been eliminated.

FIGS. 5C and 5D are similar to FIGS. 2C and 2D with the modifications mentioned.

Elements of the structure shown in FIGS. 5C and 5D which are identical to the similar elements of FIGS. 2C and 2D are designated with the same part numbers as shown in FIGS. 2C and 2D. Elements of the structure of FIGS. 5C and 5D which are similar to but somewhat modified from the structure of FIGS. 2C and 2D are indicated with a suffix A. New parts are given new numbers.

The overall valve apparatus which includes the structure of FIGS. 5C and 5D is identical to the apparatus shown in FIGS. 2A-2J except for the changes shown in FIGS. 5C and 5D. It will therefore be understood that the upper portions of the apparatus partially illustrated in FIGS. 5C and 5D would be identical to the structure shown in FIGS. 2A and 2B. It will also be understood that the lower portions of the apparatus including the structure shown in FIGS. 5C and 5D will be identical to the structure shown in FIGS. 2E-2J.

The modified apparatus of FIGS. 5C and 5D includes a power piston 156A. The power piston 156A includes a main piston 400 and a booster piston means 402.

Main piston 400 is an integral part of bottom power mandrel section 152A.

Booster piston means 402 is an annular booster piston concentrically disposed about main piston 400. Booster piston means 402 has an upper end 404 and a lower end 406.

A first annular resilient sliding seal means 408 is provided between main piston 400 and booster piston means 402.

A second annular resilient sliding seal means 410 is provided between booster piston means 402 and bore 158 of power housing section 70A.

At the upper end 404 of booster piston means 402 an engagement lug 412 extends radially inward over and engages an upper end 414 of main piston 400.

The power housing section 70A includes an annular stop lug 416 extending radially inwardly therefrom for engagement with the lower end 406 of booster piston means 402. The stop lug 416 provides a limit means for limiting movement of the booster piston means 402 in a downward direction and for allowing the main piston 400 to continue moving downward.

A lower end 418 of upper filler nipple 68 of outer housing 62 provides a second limit means for limiting movement of the booster piston means 402 in an upward direction when booster piston 402 returns to its initial position and its upper end 404 engages second limit means 418.

During the testing of an embodiment of the present invention like that shown in FIGS. 2A-2J, it became evident that very high pressures were required in the well annulus 40 to open the ball valve 136. Examination of the operating pressures showed that the annulus pressure required to initially crack open the ball valve 136 peaked after a relatively short portion of the total travel required to move the ball valve from its fully closed to its fully open position. The pressure required to continue the opening operation of the ball valve after the ball valve was initially cracked open was in most cases less than one-half of the peak operating pressure.

It is believed that this peak operating pressure and the rapid dropoff in operating pressure is due to the frictional forces within the ball valve assembly which oppose the initial opening of the ball valve because of a differential pressure in the flow passage 140 across the ball valve 136. Prior to the opening of the ball valve 136, the pressure in passage 140 below the ball valve is much greater than the pressure above the ball valve, and thus the ball valve 136 is pushed upward against the resilient seat 114 creating a high frictional force which must be overcome to turn the ball valve 136 against the resilient seat 114.

As soon as the ball valve 136 is cracked open, this pressure differential is released through the bore 138 of the ball valve 136, so that the force required to further move the ball valve 136 relative to the seat 114 is very much reduced.

One way in which the required annulus operating pressure could be reduced, would be to increase the differential area of the power piston. A fixed travel of the power mandrel is, however, required in order to open the ball valve 136. Thus, if the differential area of the power piston 156 were merely increased, and the travel remained the same, the volume displaced by the power piston 156 would be substantially increased thus increasing the necessary volume of silicone fluid in the main spring chamber 242.

By the present invention, the use of the booster piston means 402 initially provides a power piston 156A having a differential area equal to the combined differential areas of main piston 400 and booster piston 402. This provides a large differential area for the power piston during the initial portion of its travel during which the ball valve 136 is cracked open.

After the booster piston 402 and the main piston 400 have moved downward a sufficient distance to crack the ball valve 136 open, the lower end 406 of booster piston 402 engages the stop lug 416 to stop the downward movement of the booster piston 402. At this point, the operating pressure necessary to continue the opening of the ball valve 136 is very much reduced, and the differential area provided by main piston 400 is sufficient to provide sufficient force to continue moving the power mandrel downward until the ball valve 136 is fully opened.

The additional volume of silicone oil displaced by booster piston 402 was originally expected to raise the pressure of the silicone oil during the initial travel of power piston 156A. Operating tests have shown, however, that very little additional compressibility of the silicone oil is required. It is believed that this is a result of air trapped in the silicone oil.

Furthermore, tests have shown that the booster piston 402 functions in a surprising manner much different from what was expected.

It was originally expected that the booster piston 402 would engage stop lug 416 and remain abutted against stop lug 416 until such time as the well annulus pressure was reduced to reclose ball valve 136. It was assumed that this would be the case because the well annulus pressure would be greater than the silicone oil pressure thus maintaining a downward acting pressure differential across booster piston 402.

Operating tests have shown, however, that during the downward opening stroke of power piston means 156A, after lower end 406 of booster piston 402 engages stop lug 416 and as the main piston 400 continues to move rapidly downward further compressing the silicone oil, the booster piston 402 moves back upward to its initial position abutting second limit means 418. It is believed that this is a result of the momentum of the rapidly downward moving power mandrel means 148 causing a pressure surge in the silicone oil such that for a short period of time the silicone oil pressure actually exceeds the well annulus pressure. This pressure surge causes an upward acting pressure differential across the booster piston means 402 moving it back upward to its initial position.

One significant advantage provided by this unexpected phenomenon is that the decrease in silicone oil volume due to the initial downward movement of booster piston 402 is restored when booster piston 402 returns to its initial position, thus reducing the required compressibility of the silicone oil. As a result, the initial added opening force of the larger diameter booster piston 402 is provided without any significant requirement of additional silicone oil compressibility that normally would be associated with an increase in piston diameter.

Thus it is seen that the apparatus and methods of the present invention readily achieve the ends and advantages mentioned as well as those inherent therein. While certain preferred embodiments of the present invention have been illustrated and described for purposes of the present disclosure, numerous changes in the arrangement of parts and steps may be made by those skilled in the art which changes are encompassed within the scope and spirit of the present invention as defined by the appended claims.

What is claimed is:

1. A valve apparatus, comprising:

a housing having a flow passage disposed therethrough;

flow valve means disposed in said housing and movable between a closed position wherein said flow passage is closed, and an open position wherein said flow passage is open;

power mandrel means, disposed in said housing, said power mandrel means being operatively associated with said flow valve means for moving said flow valve means from its closed position to its open position upon movement of said power mandrel means in a first direction longitudinally within said housing from a first position to a second position;

a power piston included in said power mandrel means, said power piston including:

a main piston having a first differential area; and a booster piston means, operably associated with said main piston, for initially providing an additional differential area to said first differential area of said main piston, and for thereby providing an additional initial force for moving said flow valve means from its closed position to a partially open position;

power passage means disposed in said housing for transmitting pressure from a well annulus external of said housing to a first side of said power piston;

a first chamber disposed in said housing and filled at least partially with a compressible liquid, a second side of said power piston being in fluid communication with said first chamber so that pressure from said compressible liquid is transmitted to said second side of said power piston;

a second chamber disposed in said housing;

a floating piston means disposed in said second chamber and dividing said second chamber into a first zone and a second zone;

an equalizing passage means, disposed in said housing for transmitting said pressure from said well annulus external of said housing to said second zone of said second chamber;

a pressurizing passage communicating said first chamber with said first zone of said second chamber;

a first back pressure check valve means, disposed in said pressurizing passage, for allowing liquid to flow from said first zone of said second chamber through said pressurizing passage into said first chamber when a pressure in said first zone of said second chamber exceeds a pressure of said compressible liquid in said first chamber by a first predetermined value, and for preventing liquid from flowing from said first chamber through said pressurizing passage to said first zone of said second chamber;

a depressurizing passage communicating said first chamber with said first zone of said second chamber; and a second back pressure check valve means, disposed in said depressurizing passage, for allowing liquid to flow from said first chamber through said depressurizing passage into said first zone of said second chamber when the pressure in said first chamber exceeds the pressure in said first zone of said second chamber by a second predetermined value, said second predetermined value being greater than said first predetermined value, and for preventing liquid from flowing from said first zone of said second chamber through said depressurizing passage into said first chamber.

2. The apparatus of claim 1, wherein:

said first chamber is completely filled with said compressible liquid; and said first zone of said second chamber is filled with said compressible liquid.

3. The apparatus of claim 1 wherein:

said first chamber is divided into a first zone and a second zone by a second floating piston;

said first zone of said first chamber is filled with said compressible liquid;

said second zone of said first chamber is communicated with said pressurizing passage and said depressurizing passage; and both said second zone of said first chamber and said first zone of said second chamber are filled with a substantially noncompressible liquid.

4. The apparatus of claim 1, wherein:

an initial volume of said first chamber when said power mandrel means is in its first position is sufficiently large that said compressible liquid in said first chamber may be compressed into a final volume of said first chamber as said power mandrel means moves rapidly from its first position to its second position, said final volume being smaller than said initial volume.

5. The apparatus of claim 1, wherein:

said second predetermined value exceeds said first predetermined value by an amount sufficient that when a pressure differential of said amount is applied across said power piston from said second side toward said first side thereof, when said power mandrel means is in its said second position, a sufficient force is exerted on said power piston to move said power mandrel means back to its said first position.

6. The apparatus of claim 1, further comprising:

a flow impedance means, disposed in said pressurizing passage, for impeding flow of liquid through said pressurizing passage so that upon rapid pressurization of said well annulus an annulus fluid pressure in said annulus will increase faster than said annulus fluid pressure can be transmitted through said pressurizing passage to said first chamber, thereby creating a differential pressure across said power piston from said first side toward said second side thereof sufficient to move said power mandrel means from its said first position to its said second position to thereby open said flow valve means.

7. The apparatus of claim 1, further comprising:

a flow impedance means, disposed in said depressurizing passage, for impeding flow of liquid through said depressurizing passage so that when said power mandrel means is in its said second position and said well annulus is rapidly depressurized, an annulus fluid pressure in said annulus will decrease faster than the pressure of the compressible liquid in said first chamber will decrease, thereby creating a pressure differential across said power piston from said second side toward said first side thereof greater than an amount by which said second predetermined value exceeds said first predetermined value.

8. The apparatus of claim 1, wherein:

said floating piston means is arranged within said second chamber so that said floating piston means may move in either of two opposite directions relative to said housing to either increase or decrease a volume of said first zone of said second chamber to allow for both expansion and contraction of said compressible liquid due to pressure and temperature changes as said valve apparatus is lowered into a well.

9. The apparatus of claim 1, further comprising:

releasable holding means, operably associated with said housing and said power mandrel means, for holding said power mandrel means in its said first position until a pressure differential across said power piston from said first side toward said second side thereof exceeds a third predetermined value, and for holding said power mandrel means in its said second position until a pressure differential across said power piston from said second side toward said first side thereof exceeds a fourth predetermined value, said fourth predetermined value being less than a difference between said first predetermined value and said second predetermined value.

10. The apparatus of claim 9, wherein:

said releasable holding means includes a radially resilient collet sleeve connected to said housing and a shoulder extending radially outward from said power mandrel means, said sleeve and said shoulder each having upper and lower tapered surfaces arranged so that when said shoulder moves past said sleeve one of said tapered surfaces of said shoulder engages one of said tapered surfaces of said sleeve and causes said sleeve to expand radially to allow said shoulder to pass therethrough.

11. The apparatus of claim 1, wherein:

said compressible liquid is silicone oil.

12. The apparatus of claim 1, wherein:

said flow passage is a central axial flow passage; and said flow valve means is a full opening ball valve.

13. The apparatus of claim 1, wherein:

said power mandrel means and said flow valve means are so arranged and constructed that said flow valve means is moved from its closed position to its open position in one continuous movement simultaneous with movement of said power mandrel means from its first position to its second position in one continuous movement.

14. The apparatus of claim 1, wherein:

an initial volume of said first chamber when said power mandrel means is in its first position is sufficiently large that said compressible liquid in said first chamber may be compressed into a final volume of said first chamber as said power mandrel means moves rapidly from its first position to its second position, said final volume being smaller than said initial volume;

said second predetermined value exceeds said first predetermined value by an amount sufficient that when a pressure differential of said amount is applied across said power piston from said second side toward said first side thereof, when said power mandrel means is in its second position, a sufficient force is exerted on said power piston to move said power mandrel means back to its said first position;

said apparatus further includes a flow impedance means, disposed in said pressurizing passage, for impeding flow of liquid through said pressurizing passage so that upon rapid pressurization of said well annulus an annulus fluid pressure in said annulus will increase faster than said annulus fluid pressure can be transmitted through said pressurizing passage to said first chamber, thereby creating a differential pressure across said power piston from said first side toward said second side thereof sufficient to move said power mandrel means from its said first position to its said second position to thereby open said flow valve means;

said apparatus further includes a second flow impedance means, disposed in said depressurizing passage, for impeding flow of liquid through said depressurizing passage so that when said power mandrel means is in its said second position and said well annulus is rapidly depressurized, an annulus fluid pressure in said annulus will decrease faster than the pressure of the compressible liquid in said first chamber will decrease, thereby creating a pressure differential across said power piston from said second side toward said first side thereof greater than an amount by which said second predetermined value exceeds said first predetermined value;

said floating piston means is arranged within said second chamber so that said floating piston means may move in either of two opposite directions relative to said housing to either increase or decrease a volume of said first zone of said second chamber to allow for both expansion and contraction of said compressible liquid due to pressure and temperature changes as said valve apparatus is lowered into a well; and said power mandrel means and said flow valve means are so arranged and constructed that said flow valve means is moved from its closed position to its open position in one continuous movement simultaneous with movement of said power mandrel means from its first position to its second position in one continuous movement.

15. The apparatus of claim 1, further comprising:

limit means, operably associated with said booster piston means, for limiting movement of said booster piston means in said first direction when said flow valve has been moved to said partially open position and for allowing said main piston to continue moving in said first direction.

16. The apparatus of claim 15, further comprising:

second limit means, operably associated with said booster piston means, for limiting movement of said booster piston means in a second direction opposite said first direction, when said booster piston means returns to an initial position thereof.

17. The apparatus of claim 15 wherein:

an initial volume of said first chamber when said power mandrel means is in its first position is sufficiently large that said compressible liquid in said first chamber may be compressed into a final volume of said first chamber as said power mandrel means moves rapidly from its first position to its second position, said final volume being smaller than said initial volume.

18. The apparatus of claim 15, wherein:

said limit means is a stop lug extending radially inward from said housing for engaging said booster piston means and preventing further movement thereof in said first direction.

19. The apparatus of claim 1, wherein:

said booster piston means is an annular booster piston means disposed concentrically about said main piston;

said power piston includes a first annular resilient sliding seal means between said main piston and said booster piston means, and a second annular resilient sliding seal means between said booster piston means and an internal bore of said housing; and said annular booster piston means includes an engagement means for engaging said main piston, and for transferring to said main piston a force resulting from a pressure differential between said well annulus and said first chamber acting across said additional differential area of said annular booster piston means when a pressure of said well annulus exceeds a pressure in said first chamber and when said power mandrel means is in its said first position.

20. The apparatus of claim 19, further comprising:

limit means, operably associated with said booster piston means, for limiting movement of said booster piston means in said first direction when said flow valve has been moved to said partially open position and for allowing said main piston to continue moving in said first direction.

21. The apparatus of claim 20, wherein:

said limit means is a stop lug extending radially inward from said housing for engaging said booster piston means and preventing further movement thereof in said first direction.

22. The apparatus of claim 20, further comprising:

second limit means, operably associated with said booster piston means, for limiting movement of said booster piston means in a second direction opposite said first direction, when said booster piston means returns to an initial position thereof.

23. A valve apparatus, comprising:

an outer housing including:

an upper housing adapter;

a valve housing section connected to said upper housing adapter;

an upper filler nipple connected to said valve housing section;

a power housing section connected to said upper filler nipple;

a liquid spring chamber connector connected to said power housing section;

a liquid spring chamber housing section connected to said liquid spring chamber connector;

a lower filler nipple connected to said liquid spring chamber housing section;

a lower housing section connected to said lower filler nipple; and a lower housing adapter connected to said lower housing section;

valve means, disposed in said valve housing section, and movable between open and closed positions;

power mandrel means, disposed in said outer housing, and including a power piston received within a cylindrical inner bore of said power housing section, said power mandrel including:

a main piston;

an annular booster piston disposed concentrically about said main piston;

a first annular resilient sliding seal means disposed between said main piston and said booster piston;

a second annular resilient sliding seal means disposed between said booster piston and said cylindrical inner bore of said power housing section;

an engagement means, disposed on said annular booster piston, for engaging said main piston and transferring to said main piston a force developed by a differential pressure acting across said booster piston; and a stop lug means extending radially inward from said power housing section, for engaging said booster piston and preventing further movement thereof, after said valve means is partially opened; said power mandrel means being operatively associated with said valve means for movement of said valve means between its open and closed positions upon movement of said power piston within said power housing section, a lower end of said power mandrel means being slidably and sealingly received within a central bore of said liquid spring chamber connector;

a power port disposed through a wall of said power housing section and arranged to be in fluid communication with an upper side of said power piston;

a liquid spring chamber mandrel means having an upper end connected to said liquid spring chamber connector and a lower end received in a bore of said lower filler nipple, said liquid spring chamber mandrel means being spaced radially inward from said liquid spring chamber housing section so as to define an annular main spring chamber which is in fluid communication with a lower side of said power piston;

a lower mandrel having an upper end connected to said lower filler nipple and a lower end sealingly received in a bore of said lower housing adapter, said lower mandrel being spaced radially inward from said lower housing section to define an annular equalizing chamber;

a metering cartridge disposed between said lower housing section and said lower mandrel at an upper end of said equalizing chamber;

pressurizing passage means, disposed through said lower filler nipple and said metering cartridge, for communicating said main spring chamber with said equalizing chamber;

a pressurizing back pressure check valve disposed in said pressurizing passage means within said metering cartridge, for allowing liquid to flow from said equalizing chamber to said main spring chamber;

a first time delay liquid flow restriction disposed in said pressurizing passage means within said metering cartridge;

a depressurizing passage means, disposed through said lower filler nipple and said metering cartridge for communicating said main spring chamber with said equalizing chamber;

a depressurizing back pressure check valve, disposed in said depressurizing passage means within said metering cartridge, for allowing liquid to flow from said main spring chamber to said equalizing chamber;

a second time delay liquid flow restriction disposed in said depressurizing passage means within said metering cartridge;

an equalizing port disposed through a wall of said lower housing section; and a floating piston means, disposed in said equalizing chamber above said equalizing port.

24. The apparatus of claim 23, further comprising:

a limit means, operably associated with said booster piston, for limiting upward movement of said booster piston when said booster piston returns to an initial position thereof.

25. A downhole tool apparatus, comprising:

a housing;

an operating element disposed in said housing;

a power piston means disposed in said housing, one side of said power piston means being communicated with a power source of pressurized fluid, said power piston means being operably associated with said operating element so that said operating element is moved between first and second positions in response to movement of said power piston means between an initial position and a final position;

a first chamber disposed in said housing and filled at least partially with a compressible liquid, a second side of said power piston means being in fluid communication with said first chamber so that pressure from said compressible liquid is transmitted to said second side of said power piston means, said first chamber and said compressible liquid providing a compressible liquid spring means for resiliently opposing motion of said power piston means in a first direction from its initial position toward its final position and for providing a restoring force to move said power piston means back to its initial position;

wherein said power piston means includes:

a main piston having a first differential area acted upon by a pressure differential between said power source and said first chamber; and a booster piston means, operably associated with said main piston, for initially providing an additional differential area to said first differential area of said main piston and for thereby providing an additional initial force for moving said operating element through a first portion of its travel from its first position toward its second position.

26. The apparatus of claim 25 further comprising:

limit means, operably associated with said booster piston means, for limiting movement of said booster piston means in said first direction when said operating element has been moved through said first portion of its travel from its first position toward its second position and for allowing said main piston to continue moving in said first direction.

27. The apparatus of claim 26, further comprising:

second limit means, operably associated with said booster piston means, for limiting movement of said booster piston means in a second direction opposite said first direction, when said booster piston means returns to an initial position thereof.

28. The apparatus of claim 26, wherein:

said operating element is a flow valve;

said first and second positions of said flow valve are closed and open positions, respectively; and said first portion of travel of said flow valve corresponds to movement of said flow valve from its said closed position to a partially open position whereby a pressure differential across said flow valve is relieved thereby reducing a frictional force opposing continued movement of said flow valve to its open second position.

29. The apparatus of claim 28, wherein:

an initial volume of said first chamber, when said power piston means is in its initial position, is sufficiently large that said compressible liquid in said first chamber may be compressed into a final volume of said first chamber as said power piston means moves rapidly from its initial position to its final position, said final volume being smaller than said initial volume.

30. The apparatus of claim 25, wherein:

said booster piston means is an annular booster piston means disposed concentrically about said main piston;

said power piston means includes a first annular resilient sliding seal means between said main piston and said booster piston means, and a second annular resilient sliding seal means between said booster piston means and an internal bore of said housing; and said annular booster piston means includes an engagement means for engaging said main piston and transferring to said main piston a force resulting from said pressure differential between said power source and said first chamber acting across said additional differential area of said annular booster piston means, when a pressure of said power source exceeds pressure in said first chamber and when said power piston means is in its initial position.

31. The apparatus of claim 30, further comprising:

limit means, operably associated with said booster piston means, for limiting movement of said booster piston means in said first direction when said operating element has been moved through said first portion of its travel from its first position toward its second position and for allowing said main piston to continue moving in said first direction.

32. The apparatus of claim 31, further comprising:

second limit means, operably associated with said booster piston means, for limiting movement of said booster piston means in a second direction opposite said first direction, when said booster piston means returns to an initial position thereof.

33. The apparatus of claim 31, wherein:

said limit means is a stop lug extending radially inward from said housing for engaging said booster piston means and preventing further movement thereof in said first direction.

* * * * *